US009879941B2

(12) United States Patent
Compton et al.

(10) Patent No.: US 9,879,941 B2
(45) Date of Patent: Jan. 30, 2018

(54) METHOD AND SYSTEM FOR PROVIDING POWER AND DATA TO FIREARM ACCESSORIES

(71) Applicants: David Walter Compton, Kitchener (CA); Gary Edward Crocker, Kitchener (CA)

(72) Inventors: David Walter Compton, Kitchener (CA); Gary Edward Crocker, Kitchener (CA)

(73) Assignee: COLT CANADA CORPORATION (CA)

( * ) Notice: Subject to any disclaimer, the term of this patent is extended or adjusted under 35 U.S.C. 154(b) by 0 days.

(21) Appl. No.: 13/765,324

(22) Filed: Feb. 12, 2013

(65) Prior Publication Data

US 2013/0152445 A1 Jun. 20, 2013

Related U.S. Application Data

(62) Division of application No. 12/688,256, filed on Jan. 15, 2010.

(51) Int. Cl.

| | |
|---|---|
| ***F41A 19/00*** | (2006.01) |
| ***F41C 27/00*** | (2006.01) |
| ***F41G 11/00*** | (2006.01) |

(52) U.S. Cl.

CPC ..... *F41C 27/00* (2013.01); *F41G 11/003* (2013.01)

(58) Field of Classification Search

CPC ..... F41C 27/00; F41C 11/003
USPC ..... 42/84, 94, 71.01, 72, 124
See application file for complete search history.

(56) References Cited

U.S. PATENT DOCUMENTS

| | | | | |
|---|---|---|---|---|
| 1,950,835 | A | | 3/1934 | Zajac |
| 4,533,980 | A | | 8/1985 | Hayes |
| 5,033,219 | A | | 7/1991 | Johnson et al. |
| 5,142,806 | A | | 9/1992 | Swan |
| 5,237,773 | A | * | 8/1993 | Claridge ..... 42/117 |
| 5,345,707 | A | | 9/1994 | Randall |
| 5,360,949 | A | | 11/1994 | Duxbury |
| 5,555,662 | A | * | 9/1996 | Teetzel ..... 42/115 |
| 5,557,872 | A | | 9/1996 | Langner |
| 5,654,594 | A | | 8/1997 | Bjornsen, III et al. |
| 5,669,174 | A | | 9/1997 | Teetzel |

(Continued)

FOREIGN PATENT DOCUMENTS

| | | |
|---|---|---|
| CA | 2 547 081 | 6/2005 |
| CA | 2 537 839 | 12/2007 |

(Continued)

OTHER PUBLICATIONS

International Search Report dated Nov. 8, 2013 for International Application No. PCT/CA2013/050598.

(Continued)

*Primary Examiner* — Michelle Clement
(74) *Attorney, Agent, or Firm* — Cantor Colburn LLP

(57) ABSTRACT

An apparatus and method for providing power to an accessory on a firearm, the method including the steps of: detecting an accessory when attached to said firearm through actuation of a magnetic switch magnetically coupled to a magnet in the accessory via a pin located in the firearm and providing a power path with said accessory; and providing power to said accessory from a secondary source of power should power be required.

18 Claims, 10 Drawing Sheets

(56) References Cited

U.S. PATENT DOCUMENTS 5,822,905 A 10/1998 Teetzel
5,826,363 A 10/1998 Olson
5,831,841 A 11/1998 Nishino
6,163,131 A * 12/2000 Gartstein et al. ..... 320/118
6,219,952 B1 4/2001 Mossberg et al.
6,237,271 B1 5/2001 Kaminski
6,412,207 B1 * 7/2002 Crye et al. ..... 42/70.06
6,430,861 B1 8/2002 Ayers et al.
6,490,822 B1 * 12/2002 Swan ..... 42/71.01
6,499,245 B1 * 12/2002 Swan ..... 42/71.01
6,508,027 B1 1/2003 Kim
6,513,251 B2 2/2003 Huang et al.
6,618,976 B1 9/2003 Swan
6,622,416 B2 9/2003 Kim
6,779,288 B1 8/2004 Kim
6,792,711 B2 9/2004 Battaglia
6,847,587 B2 1/2005 Patterson et al.
6,849,811 B1 2/2005 Heflin et al.
6,854,206 B2 2/2005 Oz
6,865,599 B2 3/2005 Zhang
6,895,708 B2 5/2005 Kim et al.
6,899,539 B1 5/2005 Stallman et al.
6,918,066 B2 7/2005 Dutta et al.
6,925,744 B2 8/2005 Kincel
6,931,775 B2 8/2005 Burnett
7,007,586 B2 3/2006 Larroque-Lahitette et al.
7,059,076 B2 6/2006 Stoner et al.
7,096,619 B2 8/2006 Jackson et al.
7,121,036 B1 10/2006 Florence et al.
7,124,531 B1 10/2006 Florence et al.
7,131,228 B2 11/2006 Hochstrate et al.
7,144,830 B2 12/2006 Hill et al.
RE39,465 E * 1/2007 Swan ..... 42/71.01
7,216,451 B1 5/2007 Troy
7,231,606 B2 6/2007 Miller et al.
7,243,454 B1 7/2007 Cahill
D556,289 S 11/2007 Yu
7,316,003 B1 1/2008 Dulepet et al.
RE40,216 E 4/2008 Swan
7,363,741 B2 4/2008 DeSomma et al.
7,421,817 B2 * 9/2008 Larsson ..... 42/127
7,421,818 B2 9/2008 Houde-Walter
7,438,430 B2 * 10/2008 Kim ..... 362/110
7,458,179 B2 * 12/2008 Swan ..... 42/72
7,461,346 B2 12/2008 Fildebrandt
7,464,495 B2 12/2008 Cahill
7,523,580 B1 4/2009 Tankersley
7,525,203 B1 4/2009 Racho
7,548,697 B2 6/2009 Hudson et al.
7,551,121 B1 6/2009 O'Connell et al.
7,554,316 B2 6/2009 Stevens et al.
7,559,169 B2 7/2009 Hung et al.
7,562,483 B2 7/2009 Hines
7,584,569 B2 9/2009 Kallio et al.
7,605,496 B2 10/2009 Stevens et al.
7,627,975 B1 12/2009 Hines
7,640,690 B2 1/2010 Hines
7,676,975 B2 3/2010 Phillips et al.
7,698,983 B1 4/2010 Pinto et al.
D616,521 S 5/2010 Starnes
7,707,762 B1 * 5/2010 Swan ..... 42/85
7,712,241 B2 5/2010 Teetzel et al.
7,750,814 B2 7/2010 Fisher et al.
7,775,150 B2 8/2010 Hochstrate et al.
7,793,452 B1 9/2010 Samson et al.
7,818,910 B2 10/2010 Young
7,841,120 B2 11/2010 Teetzel et al.
7,866,083 B2 1/2011 Teetzel
7,868,587 B2 1/2011 Stevens et al.
7,908,784 B2 3/2011 Kim
7,909,490 B2 * 3/2011 Chou et al. ..... 362/427
7,953,369 B2 * 5/2011 Baarman ..... 455/41.1
7,954,971 B1 6/2011 Kincaid et al.
7,975,419 B2 7/2011 Darian
7,985,527 B2 * 7/2011 Tokunaga ..... 430/270.1
7,990,147 B2 * 8/2011 Driemel et al. ..... 324/318
7,994,752 B2 8/2011 Soar
8,001,715 B2 8/2011 Stokes
8,005,995 B2 8/2011 Ito et al.
8,028,459 B2 10/2011 Williams
8,028,460 B2 10/2011 Williams
8,035,340 B2 10/2011 Stevens et al.
8,039,995 B2 10/2011 Stevens et al.
8,042,967 B2 * 10/2011 Hikmet et al. ..... 362/208
8,063,773 B2 11/2011 Fisher et al.
8,091,265 B1 1/2012 Teetzel et al.
8,104,211 B2 1/2012 Darian
8,141,288 B2 3/2012 Dodd et al.
8,146,282 B2 4/2012 Cabahug et al.
8,151,505 B2 4/2012 Thompson
8,225,542 B2 * 7/2012 Houde-Walter ..... 42/72
8,251,288 B2 8/2012 Woitalla et al.
8,311,757 B2 11/2012 Lin
8,336,776 B2 12/2012 Horvath et al.
8,347,541 B1 * 1/2013 Thompson ..... 42/84
8,371,729 B2 2/2013 Sharrah et al.
8,453,369 B1 6/2013 Kincaid et al.
8,458,944 B2 * 6/2013 Houde-Walter ..... 42/72
8,464,459 B1 6/2013 Summers
8,485,085 B2 7/2013 Goree et al.
8,495,945 B1 7/2013 Kirchner et al.
8,516,731 B2 8/2013 Cabahug et al.
8,528,244 B2 9/2013 Scallie et al.
8,572,292 B2 10/2013 Ito et al.
8,635,798 B2 * 1/2014 Mulfinger ..... 42/84
8,668,496 B2 3/2014 Nolen
8,739,672 B1 6/2014 Kelly
8,826,575 B2 9/2014 Ufer et al.
9,010,002 B2 4/2015 Popa-Simil
9,151,564 B1 10/2015 Baxter
2002/0174588 A1 11/2002 Danner et al.
2003/0029072 A1 * 2/2003 Danielson et al. ..... 42/114
2003/0106251 A1 6/2003 Kim
2004/0121292 A1 6/2004 Chung et al.
2004/0198336 A1 10/2004 Jancic et al.
2005/0000142 A1 1/2005 Kim et al.
2005/0018041 A1 1/2005 Towery et al.
2005/0033544 A1 2/2005 Brooks et al.
2005/0109201 A1 5/2005 Larroque-Lahitette et al.
2005/0204603 A1 * 9/2005 Larsson ..... 42/146
2005/0241206 A1 11/2005 Teetzel et al.
2005/0241211 A1 * 11/2005 Swan ..... 42/124
2005/0268521 A1 12/2005 Cox et al.
2006/0005447 A1 1/2006 Lenner et al.
2006/0204935 A1 9/2006 McAfee et al.
2006/0288626 A1 12/2006 Kim
2007/0006509 A1 1/2007 DeSomma et al.
2007/0150556 A1 6/2007 Fukuda et al.
2007/0216392 A1 9/2007 Stevens et al.
2007/0228833 A1 10/2007 Stevens et al.
2008/0010890 A1 1/2008 Vice et al.
2008/0039962 A1 2/2008 McRae
2008/0040965 A1 2/2008 Solinsky et al.
2008/0063400 A1 3/2008 Hudson et al.
2008/0092422 A1 4/2008 Daniel et al.
2008/0108021 A1 5/2008 Slayton et al.
2008/0134562 A1 6/2008 Teetzel
2008/0170838 A1 7/2008 Teetzel et al.
2008/0190002 A1 8/2008 Hines
2008/0216380 A1 9/2008 Teetzel
2008/0219100 A1 9/2008 Fisher et al.
2008/0301994 A1 12/2008 Langevin et al.
2009/0044439 A1 2/2009 Phillips et al.
2009/0058361 A1 3/2009 John
2009/0108589 A1 4/2009 Racho
2009/0134713 A1 5/2009 Stevens et al.
2009/0218884 A1 9/2009 Soar
2009/0249216 A1 10/2009 Charka et al.
2009/0255160 A1 10/2009 Summers
2009/0305197 A1 12/2009 Lim et al.
2009/0322158 A1 12/2009 Stevens et al.
2010/0031552 A1 2/2010 Houde-Walter
2010/0083553 A1 4/2010 Montgomery
2010/0095574 A1 * 4/2010 Abst ..... 42/69.01

(56) References Cited

U.S. PATENT DOCUMENTS

| | | | | |
|---|---|---|---|---|
| 2010/0122485 | A1 | 5/2010 | Kincel | |
| 2010/0126054 | A1 | 5/2010 | Daniel et al. | |
| 2010/0154276 | A1 | 6/2010 | Kim | |
| 2010/0154280 | A1 | 6/2010 | Lafrance et al. | |
| 2010/0175293 | A1 | 7/2010 | Hines | |
| 2010/0180485 | A1 | 7/2010 | Cabahug et al. | |
| 2010/0181933 | A1 | 7/2010 | Langovsky | |
| 2010/0186278 | A1 | 7/2010 | Daniel | |
| 2010/0192443 | A1 | 8/2010 | Cabahug et al. | |
| 2010/0192444 | A1 | 8/2010 | Cabahug et al. | |
| 2010/0192446 | A1 | 8/2010 | Darian | |
| 2010/0192447 | A1 | 8/2010 | Cabahug et al. | |
| 2010/0192448 | A1 | 8/2010 | Darian | |
| 2010/0218410 | A1 | 9/2010 | Cabahug et al. | |
| 2010/0229448 | A1* | 9/2010 | Houde-Walter et al. | 42/72 |
| 2010/0242332 | A1 | 9/2010 | Teetzel et al. | |
| 2010/0275489 | A1 | 11/2010 | Cabahug et al. | |
| 2010/0279544 | A1 | 11/2010 | Dodd et al. | |
| 2010/0281725 | A1 | 11/2010 | Arbouw | |
| 2011/0000120 | A1 | 1/2011 | Thompson | |
| 2011/0006613 | A1 | 1/2011 | Stevens et al. | |
| 2011/0010979 | A1 | 1/2011 | Houde-Walter | |
| 2011/0030257 | A1* | 2/2011 | Gwillim, Jr. | 42/1.02 |
| 2011/0031928 | A1 | 2/2011 | Soar | |
| 2011/0036337 | A1* | 2/2011 | Freitag et al. | 124/32 |
| 2011/0061284 | A1 | 3/2011 | Cabahug et al. | |
| 2011/0089894 | A1 | 4/2011 | Soar | |
| 2011/0099876 | A1 | 5/2011 | Bentley | |
| 2011/0126622 | A1 | 6/2011 | Turner | |
| 2011/0131858 | A1 | 6/2011 | Darian | |
| 2011/0162245 | A1 | 7/2011 | Kamal et al. | |
| 2011/0162251 | A1 | 7/2011 | Houde-Walter | |
| 2011/0173865 | A1 | 7/2011 | Compton et al. | |
| 2011/0214328 | A1* | 9/2011 | Williams | 42/90 |
| 2011/0239354 | A1* | 10/2011 | Celona et al. | 2/422 |
| 2011/0252741 | A1 | 10/2011 | Travez et al. | |
| 2011/0264257 | A1 | 10/2011 | Travez et al. | |
| 2011/0271822 | A1 | 11/2011 | Myr | |
| 2011/0283585 | A1 | 11/2011 | Cabahug et al. | |
| 2011/0283586 | A1* | 11/2011 | Scallie et al. | 42/84 |
| 2011/0285214 | A1 | 11/2011 | Stevens et al. | |
| 2011/0306251 | A1* | 12/2011 | Mulfinger et al. | 439/733.1 |
| 2012/0021385 | A1 | 1/2012 | Belenkii et al. | |
| 2012/0068536 | A1 | 3/2012 | Stevens et al. | |
| 2012/0085331 | A1* | 4/2012 | Lang | 124/88 |
| 2012/0097741 | A1 | 4/2012 | Karcher | |
| 2012/0125092 | A1 | 5/2012 | Downing | |
| 2012/0125189 | A1* | 5/2012 | Mclean, III | 89/132 |
| 2012/0131837 | A1 | 5/2012 | Cabahug et al. | |
| 2012/0143368 | A1 | 6/2012 | Travez et al. | |
| 2012/0144714 | A1 | 6/2012 | Cabahug et al. | |
| 2012/0144716 | A1 | 6/2012 | Cabahug et al. | |
| 2012/0180363 | A1 | 7/2012 | Frascati et al. | |
| 2012/0180364 | A1* | 7/2012 | Berntsen et al. | 42/90 |
| 2012/0192476 | A1* | 8/2012 | Compton et al. | 42/84 |
| 2012/0214137 | A1 | 8/2012 | Goree et al. | |
| 2012/0233901 | A1 | 9/2012 | Kim et al. | |
| 2012/0285064 | A1* | 11/2012 | Houde-Walter | 42/72 |
| 2013/0047482 | A1 | 2/2013 | Mulfinger | |
| 2013/0047486 | A1 | 2/2013 | Ding et al. | |
| 2013/0061504 | A1* | 3/2013 | Malherbe et al. | 42/84 |
| 2013/0061509 | A1 | 3/2013 | Allen et al. | |
| 2013/0104438 | A1 | 5/2013 | Hines | |
| 2013/0104439 | A1 | 5/2013 | Hines | |
| 2013/0105579 | A1 | 5/2013 | Miller | |
| 2013/0185978 | A1 | 7/2013 | Dodd et al. | |
| 2013/0286239 | A1 | 10/2013 | Lupher et al. | |
| 2013/0329211 | A1 | 12/2013 | McHale et al. | |
| 2013/0337415 | A1 | 12/2013 | Huet | |
| 2013/0344461 | A1 | 12/2013 | Tello | |
| 2014/0007485 | A1 | 1/2014 | Castejon, Sr. | |
| 2014/0028856 | A1 | 1/2014 | Ehrlich | |
| 2014/0047754 | A1 | 2/2014 | Compton et al. | |
| 2014/0052578 | A1 | 2/2014 | Redwood | |
| 2014/0052878 | A1 | 2/2014 | Ito et al. | |
| 2014/0059911 | A1* | 3/2014 | Oh et al. | 42/16 |
| 2014/0068990 | A1 | 3/2014 | Cabahug et al. | |
| 2014/0130392 | A1 | 5/2014 | Oh et al. | |
| 2014/0184476 | A1 | 7/2014 | McHale et al. | |
| 2014/0360081 | A1 | 12/2014 | Lupher et al. | |
| 2014/0378088 | A1 | 12/2014 | Goel et al. | |
| 2015/0020427 | A1 | 1/2015 | Compton et al. | |
| 2015/0026588 | A1 | 1/2015 | Turcotte et al. | |
| 2015/0041538 | A1 | 2/2015 | Teetzel et al. | |
| 2015/0108215 | A1 | 4/2015 | Ehrlich | |
| 2015/0176949 | A1 | 6/2015 | Varshneya | |
| 2015/0285593 | A1 | 10/2015 | Dribben | |
| 2015/0285599 | A1 | 10/2015 | Downing | |
| 2015/0300786 | A1 | 10/2015 | Downing et al. | |
| 2015/0345887 | A1 | 12/2015 | Shneorson | |
| 2015/0345906 | A1 | 12/2015 | Varshneya | |
| 2015/0369554 | A1 | 12/2015 | Kramer | |
| 2016/0025446 | A1 | 1/2016 | Downing et al. | |
| 2016/0025462 | A1 | 1/2016 | Downing | |
| 2016/0033221 | A1 | 2/2016 | Schmehl | |
| 2016/0084617 | A1 | 3/2016 | Lyren | |
| 2016/0169627 | A1 | 6/2016 | Northrup | |
| 2016/0216082 | A1 | 7/2016 | Downing | |
| 2016/0223278 | A1 | 8/2016 | Schechter | |
| 2016/0316128 | A1 | 10/2016 | Teich | |

FOREIGN PATENT DOCUMENTS

| | | | |
|---|---|---|---|
| CA | 2756018 | | 9/2010 |
| CA | 2 754 852 | | 6/2012 |
| CA | 2 754 869 | | 8/2012 |
| CA | 2923506 | | 3/2015 |
| DE | 2251670 | A1 | 5/1974 |
| DE | 102004045753 | | 3/2006 |
| EP | 2587659 | A1 | 5/2013 |
| TW | 200715159 | A | 4/2007 |
| WO | 2005080908 | A2 | 9/2005 |
| WO | 2005109597 | A1 | 11/2005 |
| WO | 2008048116 | A1 | 4/2008 |
| WO | 2008108818 | | 12/2008 |
| WO | 2009127354 | | 10/2009 |
| WO | 2009151713 | A2 | 12/2009 |
| WO | 2010004470 | | 1/2010 |
| WO | 2010107324 | A1 | 9/2010 |
| WO | 2011079233 | A2 | 6/2011 |
| WO | 2011162245 | A1 | 12/2011 |
| WO | 2013066472 | | 5/2013 |
| WO | 2013011242 | | 8/2013 |
| WO | 2013120015 | | 8/2013 |
| WO | 2014026274 | A1 | 2/2014 |

OTHER PUBLICATIONS

Written Opinion dated Nov. 8, 2013 for International Application No. PCT/CA2013/050598.

Singapore Search Report dated Oct. 15, 2013 for Application No. 201205195-9.

International Search Report for PCT/CA2012/050080; Date of Mailing Jun. 4, 2012.

International Search Report for PCT/USCA2010/000039; Date of Mailing: Oct. 15, 2010.

Written Opinion for PCT/CA2012/050080; Date of Mailing Jun. 4, 2012.

International Search Report for PCT/CA2012/050080; Date of Mailing May 16, 2012.

Written Opinion for PCT/CA2012/050080; Date of Mailing May 16, 2012.

International Preliminary Report dated Aug. 29, 2013 for International Application No. PCT/CA2012/050080.

Written Opinion for International Application No. PCT/CA2014/050854; dated Nov. 6, 2014.

International Search Report for International Application No. PCT/CA2014/050854; dated Nov. 6, 2014.

Written Opinion for International Application No. PCT/CA2014/050837; dated Oct. 27, 2014.

International Search Report for International Application No. PCT/CA2014/050837; datedOct. 27, 2014.

(56) References Cited

OTHER PUBLICATIONS

Machine Translation of claims of DE102004045753.
English Abstract of DE102004045753.
Machine Translation of Specification of DE102004045753.
Written Opinion for International Application No. PCT/CA2014/051006; dated Dec. 23, 2014.
International Search Report for International Application No. PCT/CA2014/051006; dated Dec. 23, 2014.
U.S. Non-Final Office Action for U.S. Appl. No. 14/553,955, filed Nov. 25, 2014; dated Jul. 1, 2016; 32 pgs.
Australian Office Action for Application No. 2012218790; dated Feb. 9, 2016; 3 pgs.
English Abstract for DE2251670A1—May 2, 1974; 1 pg.
English Abstract for WO2011062245A1—Dec. 29, 2011; 2 pgs. Also related to cited reference EP2587659A1—May 1, 2013.
European Office Action for Application No. 12747770.1-1655; dated Jun. 18, 2015; 4 pgs.
International Search Report for International Application No. PCT/CA2010/000039; International filing date: Jan. 15, 2010; dated Oct. 15, 2010, 3 pgs.
International Search Report for International Application No. PCT/CA2015/0051369; International filing Date: Dec. 23, 2015; dated Mar. 8, 2016; 3 pgs.
International Written Opinion for International Application No. PCT/CA2015/051369; International filing date: Dec. 23, 2015; dated Mar. 8, 2016; 4 pgs.
International Written Opinion for International Application No. PCT/CA2015/051369; International filing date: Jan. 15, 2010; dated Oct. 15, 2010; 5 pgs.
New Zealand Office Action for IP No. 709884; dated Jul. 29, 2015; 2 pgs.
Non-Final Office Action for U.S. Appl. No. 14/808,535, filed Jul. 24, 2015; dated Apr. 13, 2016; 32 pgs.
Supplementray European Search Report for application No. EP13829390.7; dated Mar. 9, 2016; 9 pgs.
Extended European Search Report for EP Application No. 16162291.5.
ISR/WO, Issued Jul. 21, 2016, International Search Report for International Application No. PCT/CA2016/050591; dated Jul. 21, 2016.
Written Opinion for International Application No. PCT/CA2016/050591; International Filing Date: May 26, 2016; dated Jul. 21, 2016; 6 pgs.
"Interoperability and Integration of Dismounted Soldier System Weapon Systems", Major Bruce Gilchrist on behalf of Mr. Mark Richter, SCI-178 RTG-043; May 20, 2009.
"Interoperability and Integration of Dismounted Soldier System Weapon Systems Update", Mr. Mark Richter; Chairman; SCI-178 RTG-043; May 21, 2008.
"Powered Rail"; Presentation to Intl Infantry & Joint Small Arms System Symposium; May 20, 2009; Torbjoem Eld; Chairman; Powered rail team, NATO SCI-187/RTG-043.
European Search Report for Application No. EP 16 19 5258, dated Mar. 29, 2017.
CA Examination report for Application No. 2014331482, dated Mar. 22, 2017.
CA Office Action for Application No. 2,923,513, dated May 3, 2017.

* cited by examiner

METHOD AND SYSTEM FOR PROVIDING POWER AND DATA TO FIREARM ACCESSORIES

CROSS REFERENCE TO RELATED APPLICATIONS

This application is a divisional of U.S. patent application Ser. No. 12/688,256 filed Jan. 15, 2010, the contents of which are incorporated herein by reference thereto.

FIELD OF THE INVENTION

Embodiments of the invention relate generally to an inductively powering rail mounted on a device such as a firearm to provide power to accessories, such as: telescopic sights, tactical sights, laser sighting modules, and night vision scopes.

BACKGROUND OF THE INVENTION

Current accessories mounted on a standard firearm rail such as a MIL-STD-1913 rail, Weaver rail, or NATO STANAG 4694 accessory rail require that they utilize a battery contained in the accessory. As a result multiple batteries must be available to replace failing batteries in an accessory. Embodiments of the present invention utilize multiple battery power sources to power multiple accessories through the use of an induction system, mounted on a standard firearms rail.

SUMMARY OF THE INVENTION

In one embodiment of the invention a system for providing inductive power to an accessory on a firearm is provided. The system having: an inductively powering rail operatively connected to one or more batteries, the inductively powering rail comprising a plurality of inductively powering rail slots, each inductively powering rail slot having a primary U-Core, the accessory having secondary U-Cores designed to mate with each primary U-Core to provide an inductive power connection to the accessory.

In a further embodiment, a method for providing inductive power to an accessory on a firearm is provided; the method including the steps of: detecting an accessory when attached to the firearm and providing an inductive power path with the accessory; and providing power to the accessory from a secondary source should power be required.

In another embodiment, a method for providing power to an accessory on a firearm is provided. The method including the steps of: detecting an accessory when attached to said firearm through actuation of a magnetic switch magnetically coupled to a magnet in the accessory via a pin located in the firearm and providing a power path with said accessory; and providing power to said accessory from a secondary source of power should power be required.

In yet another embodiment, a communication system for a powered rail of a firearm is provided. The system having: a powered rail operatively connected to a power supply; an accessory configured to releasably engage the powered rail; at least one pin located within the powered rail; at least one magnet, located within the accessory; at least one magnetic switch located within the powered rail, wherein the at least one pin is configured to magnetically couple the at least one magnet to the at least one magnetic switch when the accessory engages the powered rail.

In yet another embodiment, a system for a powered rail of a firearm is provided. The system having: a powered rail operatively connected to a power supply; an accessory configured to releasably engage the powered rail; at least one pin located within the powered rail; at least one magnet, located within the accessory; at least one magnetic switch located within the powered rail, wherein the at least one pin is configured to magnetically couple the at least one magnet to the at least one magnetic switch when the accessory engages the powered rail.

In still another embodiment, a method for providing power to an accessory on a firearm is provided, the method including the steps of: detecting an accessory when attached to said firearm through actuation of a magnetic switch magnetically coupled to a magnet in the accessory via a pin located in the firearm and providing a power path with said accessory; and providing power to said accessory from a secondary source of power should power be required.

Other aspects and features of embodiments of the invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Disclosed herein is a method and system for an inductively powering rail on a firearm to power accessories such as: telescopic sights, tactical sights, laser sighting modules, Global Positioning Systems (GPS) and night vision scopes. This list is not meant to be exclusive, merely an example of accessories that may utilize an inductively powering rail. The connection between an accessory and the inductively powering rail is achieved by having electromagnets, which we refer to as "primary U-Cores" on the inductively powering rail and "secondary U-Cores" on the accessory. Once in contact with the inductively powering rail, through the use of primary and secondary U-cores, the accessory is able to obtain power through induction.

Embodiments avoid the need for exposed electrical contacts, which may corrode or cause electrical shorting when submerged, or subjected to shock and vibration. This eliminates the need for features such as wires, pinned connections or watertight covers.

Accessories may be attached to various fixture points on the inductively powering rail and are detected by the firearm once attached. The firearm will also be able to detect which accessory has been attached and the power required by the accessory.

Figure 1:
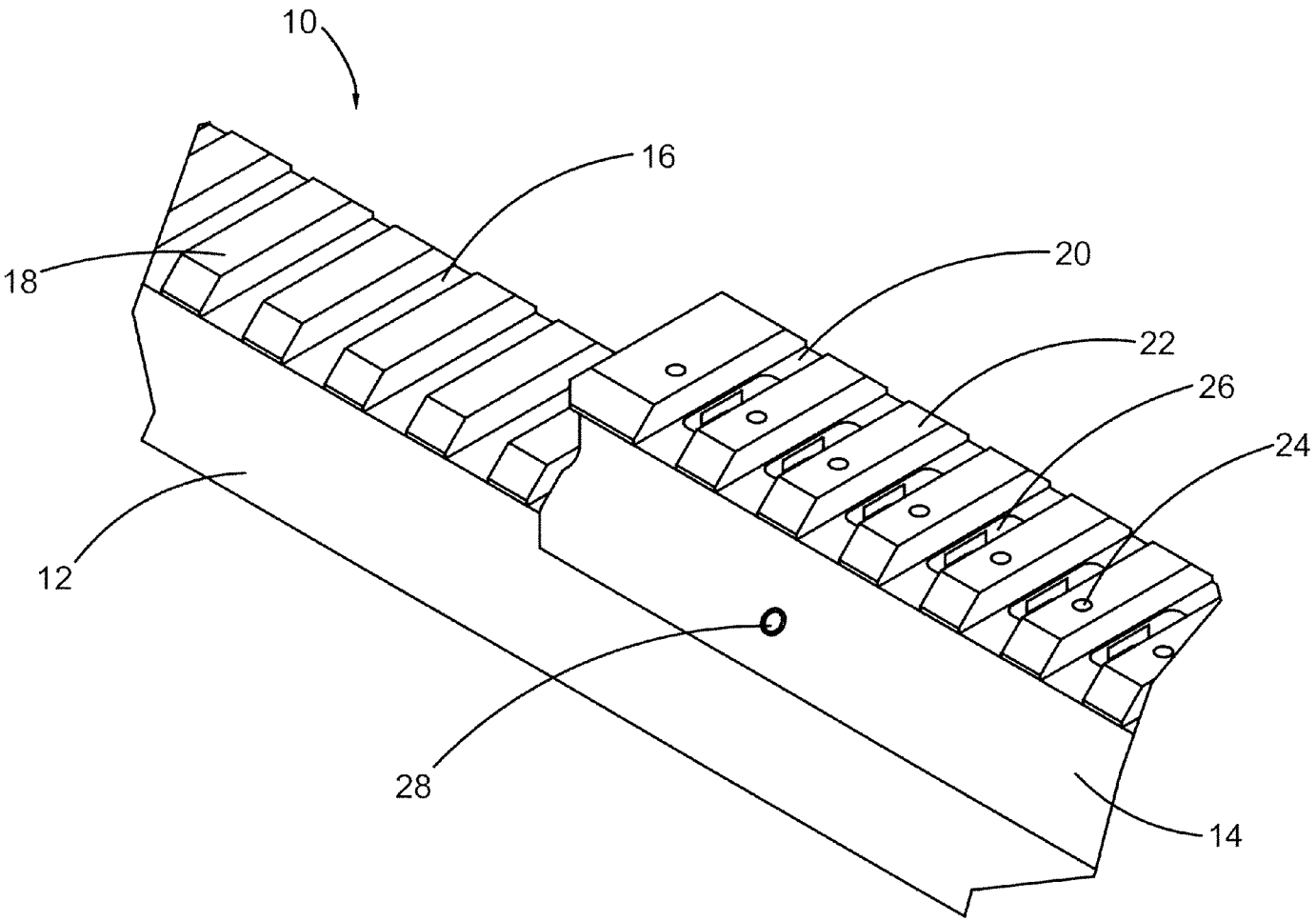
FIG. 1 is a perspective view of an inductively powering rail mounted on a MIL-STD-1913 rail.

Referring now to FIG. 1, a perspective view of an inductively powering rail mounted on a MIL-STD-1913 rail is shown generally as 10.

Feature 12 is a MIL-STD-1913 rail, such as a Weaver rail, NATO STANAG 4694 accessory rail or the like. Sliding over rail 12 is an inductively powering rail 14. Rail 12 has a plurality of rail slots 16 and rail ribs 18, which are utilized in receiving an accessory. An inductively powering rail 14 comprises a plurality of rail slots 20, rail ribs 22 and pins 24, in a configuration that allows for the mating of accessories with inductively powering rail 14. It is not the intent of the inventors to restrict embodiments to a specific rail configuration, as it may be adapted to any rail configuration. The preceding serves only as an example of several embodiments to which inductively powering rail 14 may be mated. In other embodiments, the inductively powering rail 14 can be mounted to devices having apparatus adapted to receive the rail 14.

Pins 24 in one embodiment are stainless steel pins of grade 430. When an accessory is connected to inductively powering rail 14, pins 24 connect to magnets 46 and trigger magnetic switch 48 (see FIG. 3) to indicate to the inductively powering rail 14 that an accessory has been connected. Should an accessory be removed the connection is broken and recognized by the system managing inductively powering rail 14. Pins 24 are offset from the centre of inductively powering rail 14 to ensure an accessory is mounted in the correct orientation, for example a laser accessory or flashlight accessory could not be mounted backward, and point in the user's face as it would be required to connect to pins 24, to face away from the user of the firearm. Pin hole 28 accepts a cross pin that locks and secures the rails 12 and 14 together.

Figure 2:
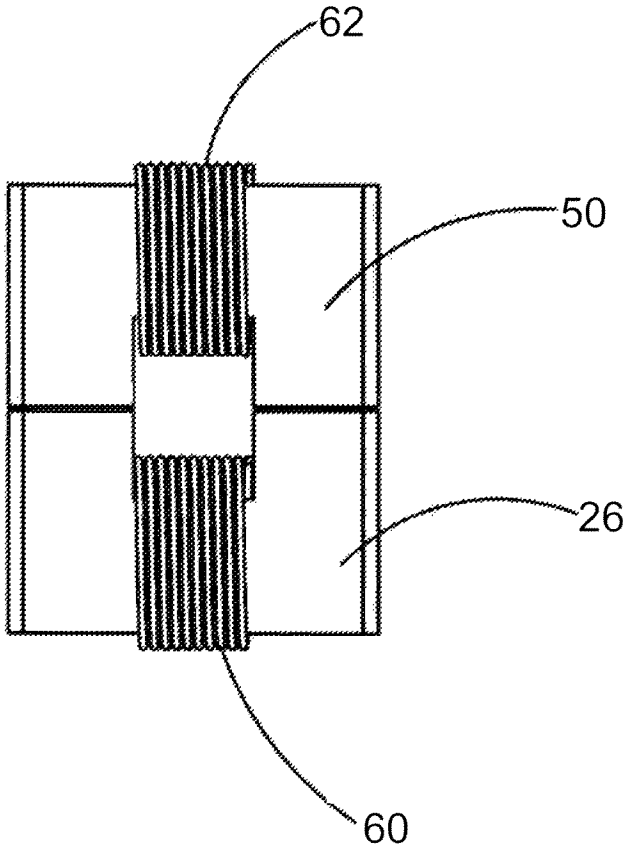
FIG. 2 is cross section vertical view of a primary U-Core and a secondary U-Core.

Referring now to FIG. 2, a cross section vertical view of a primary U-Core and a secondary U-Core is shown. Primary U-Core 26 provides inductive power to an accessory when connected to inductively powering rail 14. Each of primary U-core 26 and secondary U-core 50 are electromagnets. The wire wrappings 60 and 62 provide an electromagnetic field to permit inductive power to be transmitted bi-directionally between inductively powering rail 14 and an accessory. Power sources for each primary U-core 26 or secondary U-core 50 may be provided by a plurality of sources. A power source may be within the firearm, it may be within an accessory or it may be provided by a source such as a battery pack contained in the uniform of the user that is connected to the firearm, or by a super capacitor connected to the system. These serve as examples of diverse power sources that may be utilize by embodiments of the invention.

Figure 3:
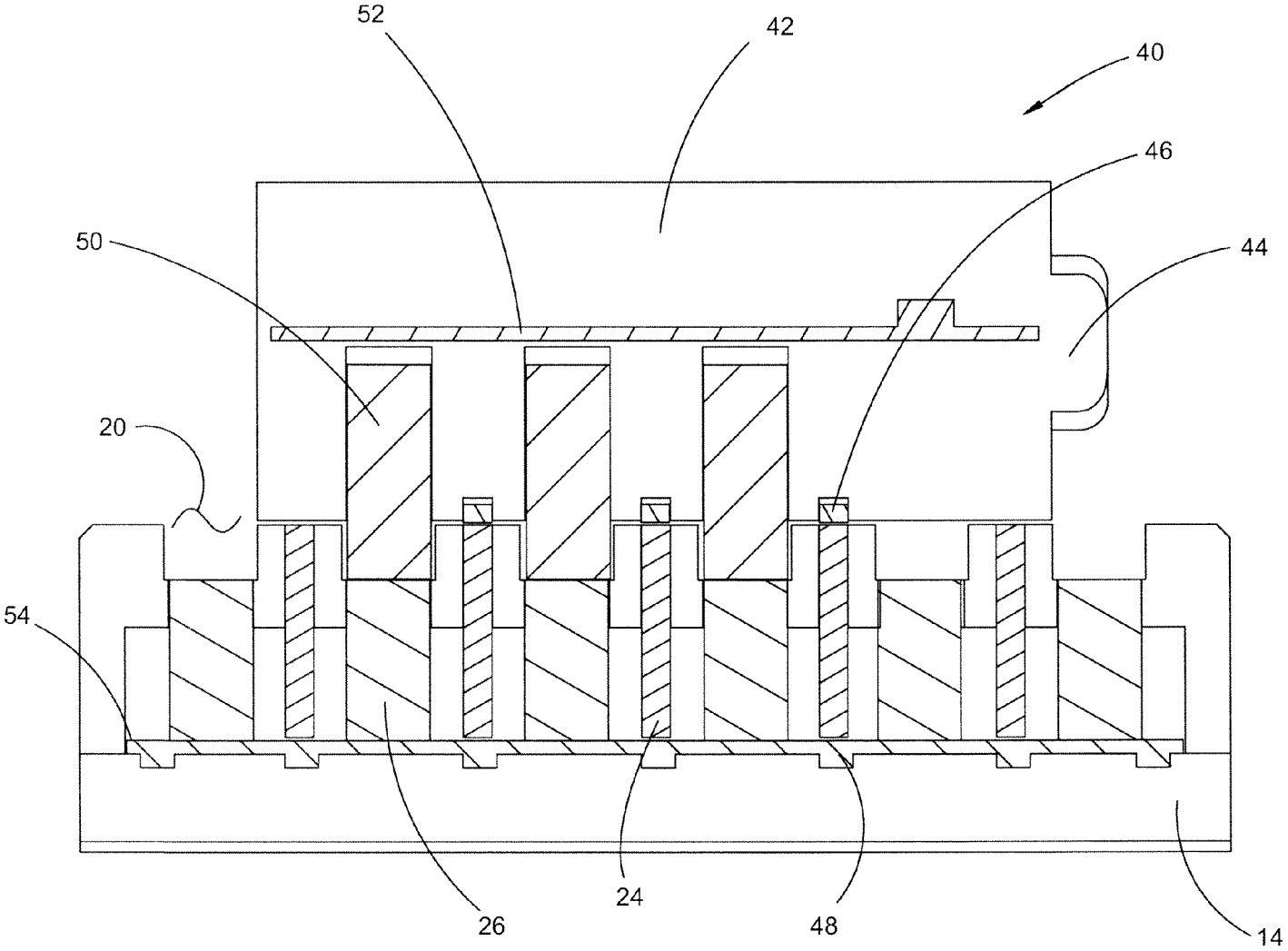
FIG. 3 is a longitudinal cross section side view of an accessory mounted to an inductively powering rail.

Referring now to FIG. 3, a longitudinal cross section side view of an accessory mounted to an inductively powering rail 14; is shown generally as 40. Accessory 42 in this example is a lighting accessory, having a forward facing lens 44. Accessory 42 connects to inductively powering rail 14, through magnets 46 which engage pins 24 and trigger magnetic switch 48 to establish an electrical connection, via primary PCB 54, to inductively powering rail 14.

As shown in FIG. 3, three connections have been established to inductively powering rail 14 through the use of magnets 46. In addition, three secondary U-cores 50 connect to three primary U-cores 26 to establish an inductive power source for accessory 42.

To avoid cluttering the Figure, we refer to the connection of secondary U-core 50 and primary U-core 26 as an example of one such mating. This connection between U-cores 50 and 26 allows for the transmission of power to and from the system and the accessory. There may be any number of connections between an accessory 42 and an inductively powering rail 14, depending upon power requirements. In one embodiment each slot provides on the order of two watts.

In both the accessory 42 and the inductively powering rail 14 are embedded Printed Circuit Boards (PCBs), which contain computer hardware and software to allow each to communicate with each other. The PCB for the accessory 42 is shown as accessory PCB 52. The PCB for the inductively powering rail 14 is shown as primary PCB 54. These features are described in detail with reference to FIG. 5 and FIG. 6.

Figure 4:
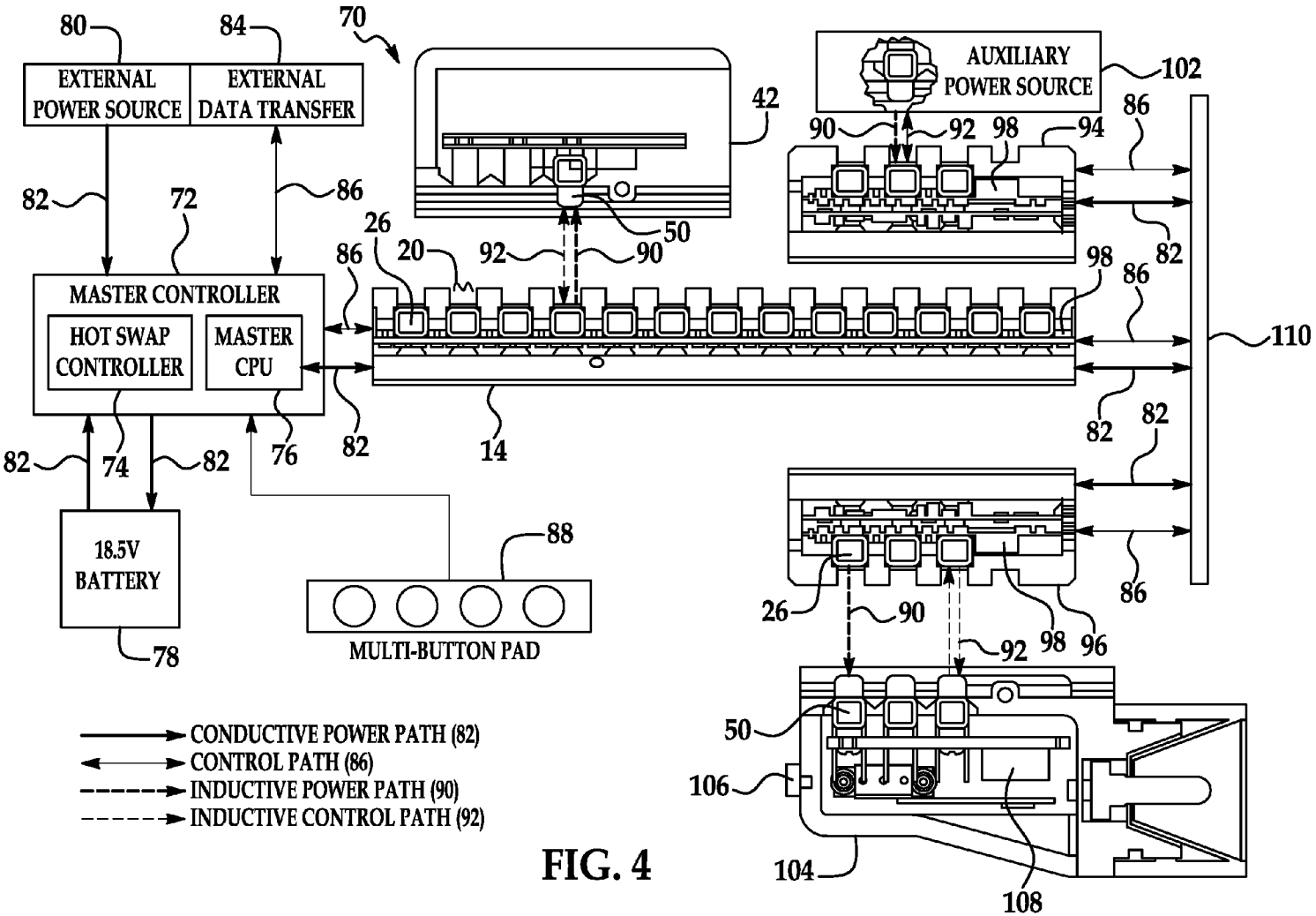
FIG. 4 is a block diagram of the components of one embodiment of an inductively powered rail system.

Referring now to FIG. 4 a block diagram of the components of an inductively powered rail system is shown generally as 70.

Figure 9:
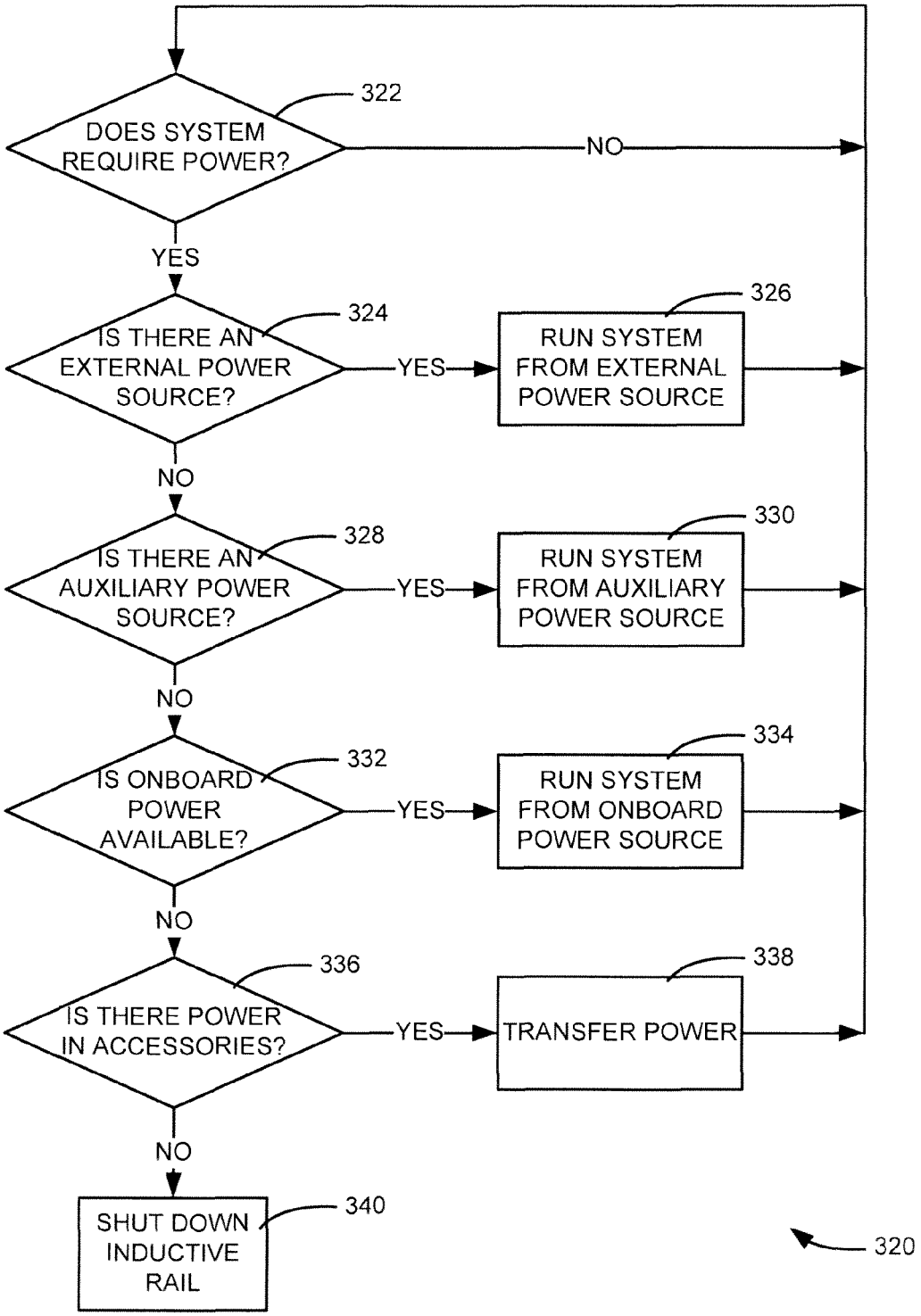
FIG. 9 is a flow chart of the steps for managing power usage.

System 70 may be powered by a number of sources, all of which are controlled by master controller 72. Hot swap controller 74 serves to monitor and distribute power within system 70. The logic of power distribution is shown in FIG. 9. Hot swap controller 74 monitors power from multiple sources. The first in one embodiment being one or more 18.5V batteries 78 contained within the system 70, for example in the stock or pistol grip of a firearm. This voltage has been chosen as optimal to deliver two watts to each inductively powering rail slot 20 to which an accessory 42 is connected. This power is provided through conductive power path 82. A second source is an external power source 80, for example a power supply carried external to the system by the user. The user could connect this source to the system to provide power through conductive power path 82 to recharge battery 78. A third source may come from accessories, which may have their own auxiliary power source 102, i.e. they have a power source within them. When connected to the system, this feature is detected by master CPU 76 and the power source 102 may be utilized to provide power to other accessories through inductive power path 90, should it be needed.

Power is distributed either conductively or inductively. These two different distribution paths are shown as features 82 and 90 respectively. In essence, conductive power path 82 powers the inductively powering rail 14 while inductive power path 90 transfers power between the inductively powering rail 14 and accessories such as 42.

Master CPU 76 in one embodiment is a Texas Instrument model MSP430F228, a mixed signal processor, which oversees the management of system 70. Some of its functions include detecting when an accessory is connected or disconnected, determining the nature of an accessory, managing power usage in the system, and handling communications between the rail(s), accessories and the user.

Shown in FIG. 4 are three rails. The first being the main inductively powering rail 14 and side rail units 94 and 96. Any number of rails may be utilized. Side rail units 94 and 96 are identical in configuration and function identically to inductively powering rail unit 14 save that they are mounted on the side of the firearm and have fewer inductively powered rail slots 20. Side rail units 94 and 96 communicate with master CPU 76 through communications bus 110, which also provides a path for conductive power. Communications are conducted through a control path 86. Thus Master CPU 76 is connected to inductively powering rail 14 and through rail 14 to the microcontrollers 98 of side rails 94 and 96. This connection permits the master CPU 76 to determine when an accessory has been connected, when it is disconnected, its power level and other data that may be useful to the user, such as GPS feedback or power level of an accessory or the system. Data that may be useful to a user is sent to external data transfer module 84 and displayed to the user. In addition data such as current power level, the use of an accessory power source and accessory identification may be transferred between accessories. Another example would be data indicating the range to a target which could be communicated to an accessory 42 such as a scope.

Communications may be conducted through an inductive control path 92. Once an accessory 42, such as an optical scope are connected to the system, it may communicate with the master CPU 76 through the use of inductive control paths 92. Once a connection has been made between an accessory and an inductively powering rail 14, 94 or 96 communication is established from each rail via frequency modulation on an inductive control path 92, through the use of primary U-cores 26 and secondary U-Cores 50. Accessories such as 42 in turn communicate with master CPU 76 through rails 14, 94 or 96 by load modulation on the inductive control path 92.

By the term frequency modulation the inventors mean Frequency Shift Key Modulation (FSK). A rail 14, 94, or 96 sends power to an accessory 42, by turning the power on and off to the primary U-core 26 and secondary U-core 50. This is achieved by applying a frequency on the order of 40 kHz. To communicate with an accessory 42 different frequencies may be utilized. By way of example 40 kHz and 50 kHz may be used to represent 0 and 1 respectively. By changing the frequency that the primary U-cores are turned on or off information may be sent to an accessory 42. Types of information that may be sent by inductive control path 92 may include asking the accessory information about itself, telling the accessory to enter low power mode, ask the accessory to transfer power. The purpose here is to have a two way communication with an accessory 42.

By the term load modulation the inventors mean monitoring the load on the system 70. If an accessory 42 decreases or increases the amount of power it requires then master CPU 76 will adjust the power requirements as needed.

Accessory 104 serves as an example of an accessory, being a tactical light. It has an external power on/off switch 106, which many accessories may have as well as a safe start component 108. Safe start component 108 serves to ensure that the accessory is properly connected and has appropriate power before turning the accessory on.

Multi button pad 88 may reside on the firearm containing system 70 or it may reside externally. Multi button pad 88 permits the user to turn accessories on or off or to receive specific data, for example the distance to a target or the current GPS location. Multi-button pad 88 allows a user to access features the system can provide through external data transfer module 84.

Figure 5:
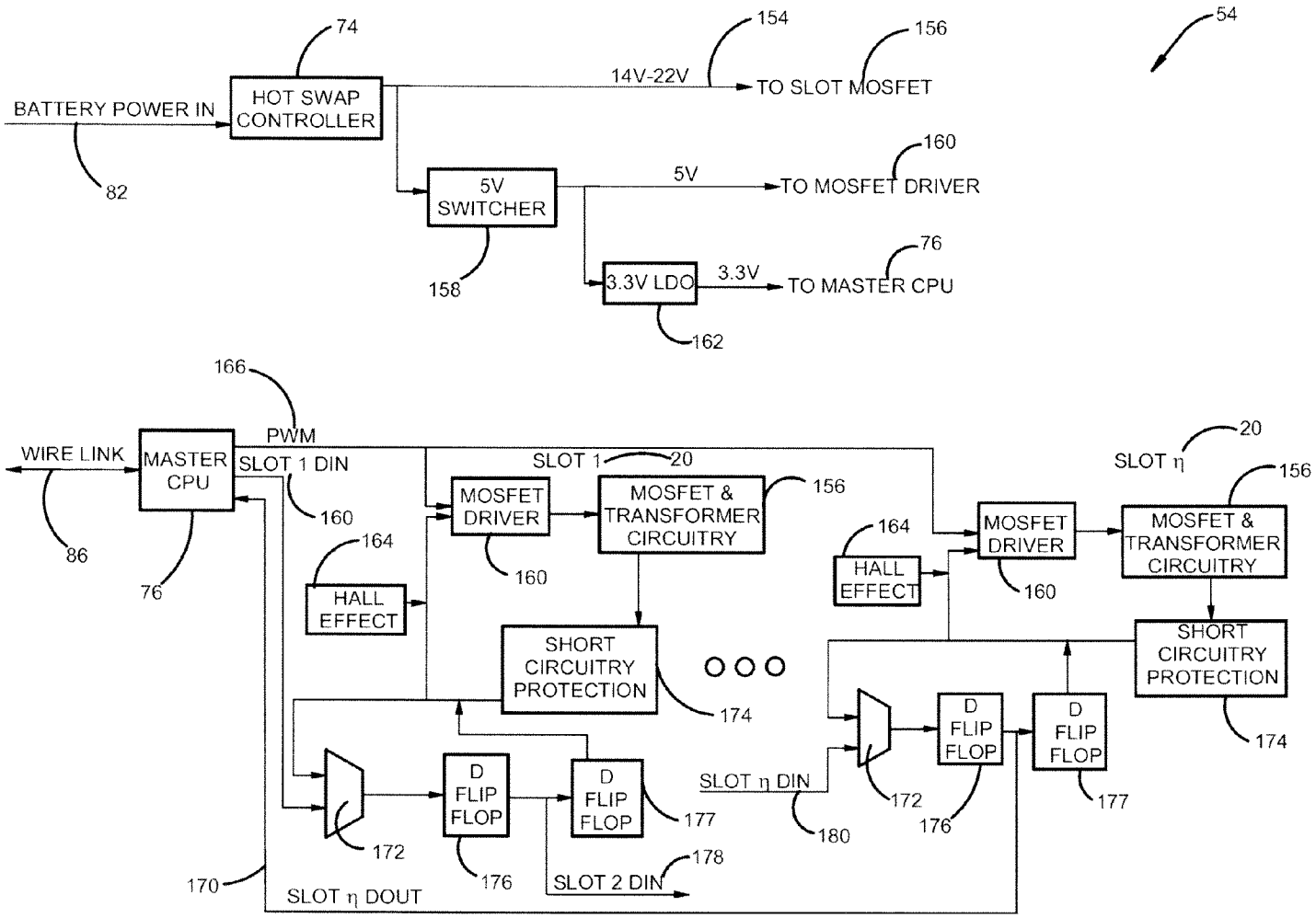
FIG. 5 is a block diagram of a primary Printed Circuit Board (PCB) contained within an inductively powering rail.

Referring now to FIG. 5 a block diagram of a primary Printed Circuit Board (PCB) contained within an inductively powering rail is shown as feature 54.

Power is received by PCB 54 via conductive power path 82 from master controller 72 (see FIG. 4). Hot swap controller 74 serves to load the inductively powering rail 14 slowly. This reduces the amount of in rush current during power up. It also limits the amount of current that can be drawn from the inductively powering rail 14. Conductive power is distributed to two main components, the inductively powering rail slots 20 and the master CPU 76 residing on PCB 54.

Hot swap controller 74 provides via feature 154, voltage in the range of 14V to 22V which is sent to a MOSFET and transformer circuitry 156 for each inductively powering rail slot 20 on inductively powering rail 14.

Feature 158 is a 5V switcher that converts battery power to 5V for the use of MOSFET drivers 160. MOSFET drivers 160 turn the power on and off to MOSFET and transformer circuitry 156 which provides the power to each primary U-Core 26. Feature 162 is a 3.3V Linear Drop Out Regulator (LDO), which receives its power from 5V switcher 158. LDO 162 provides power to master CPU 76 and supporting logic within each slot. Supporting logic is Multiplexer 172 and D Flip Flops 176.

The Multiplexer 172 and the D Flip-Flops 176, 177 are utilized as a serial shift register. Any number of multiplexers 172 and D Flip-Flops 176, 177 may be utilized, each for one inductively powered rail slot 20. This allows master CPU 76 to determine which slots are enabled or disabled and to also enable or disable a slot. The multiplexer 172 is used to select between shifting the bit from the previous slot or to provide a slot enable signal. The first D Flip Flop 176 latches the content of the Multiplexer 172 and the second D Flip-Flop 177 latches the value of D Flip-Flop 177 if a decision is made to enable or disable a slot.

Hall effect transistor 164 detects when an accessory is connected to inductively powering rail 14 and enables MOSFET driver 160.

Figure 6:
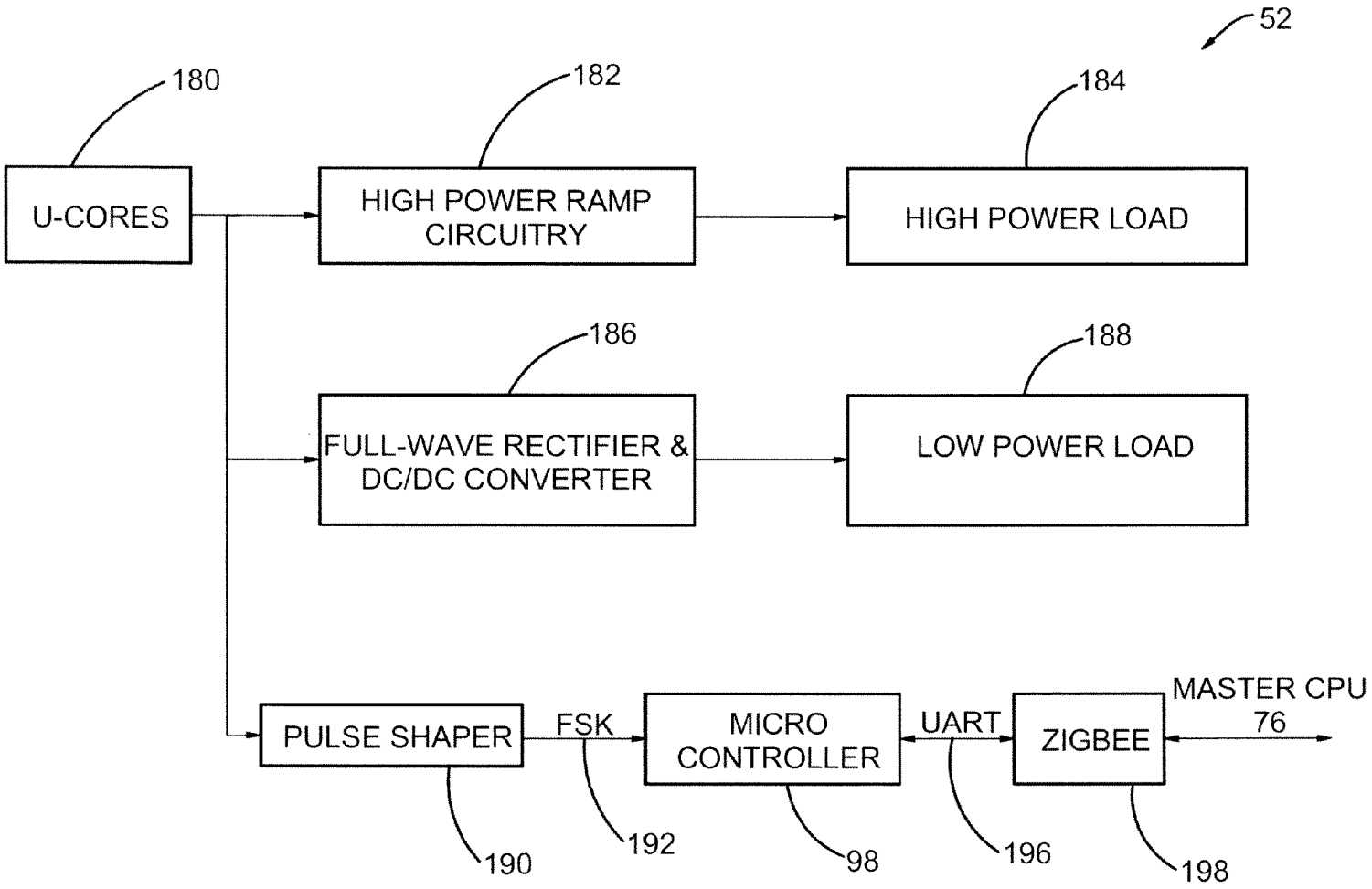
FIG. 6 is a block diagram of a PCB contained within an accessory.

Referring now to FIG. 6 a block diagram of a PCB contained within an accessory such as 42 is shown generally as 52. Feature 180 refers to the primary U-Core 26 and the secondary U-Core 50, establishing a power connection between inductively powering rail 14 and accessory 42. High power ramp circuitry 182 slowly ramps the voltage up to high power load when power is turned on. This is necessary as some accessories such as those that utilize XEON bulbs when turned on have low resistance and they draw excessive current. High power load 184 is an accessory that draws more than on the order of two watts of power.

Full wave rectifier and DC/DC Converter 186 rectifies the power from U-Cores 180 and converts it to a low power load 188, for an accessory such as a night vision scope. Pulse shaper 190 clamps the pulse from the U-Cores 180 so that it is within the acceptable ranges for microcontroller 98 and utilizes FSK via path 192 to provide a modified pulse to microcontroller 98. Microcontroller 98 utilizes a Zigbee component 198 via Universal Asynchronous Receiver Transmitter component (UART 196) to communicate between an accessory 42 and master controller 72. The types of information that may be communicated would include asking the accessory for information about itself, instructing the accessory to enter low power mode or to transfer power.

Figure 7:
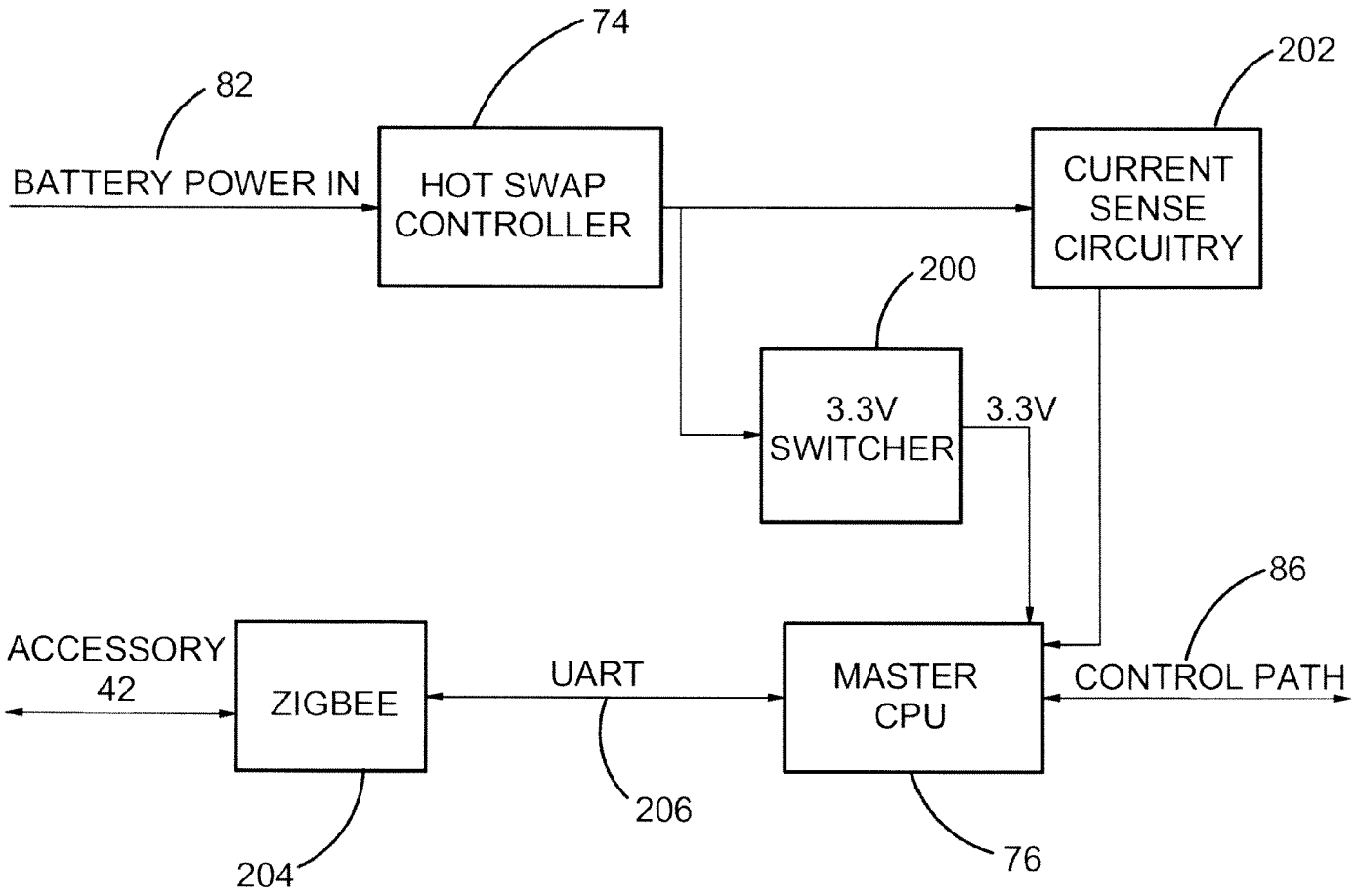
FIG. 7 is a block diagram of the components of a master controller.

Referring now to FIG. 7, a block diagram of the components of a master controller 72 is shown (see FIG. 1) Conductive power is provided from battery 78 via conductive power path 82. Not swap controller 74 slowly connects the load to the inductively powering rail 14 to reduce the amount of in rush current during power up. This also allows for the limiting of the amount of current that can be drawn. Feature 200 is a 3.3 v DC/DC switcher, which converts the battery voltage to 3.3V to be used by the master CPU 76.

Current sense circuitry 202 measures the amount of the current being used by the system 70 and feeds that information back to the master CPU 76. Master controller 72 also utilizes a Zigbee component 204 via Universal Asynchronous Receiver Transmitter component (UART) 206 to communicate with accessories connected to the inductively powering rail 14, 94 or 96.

Figure 8:
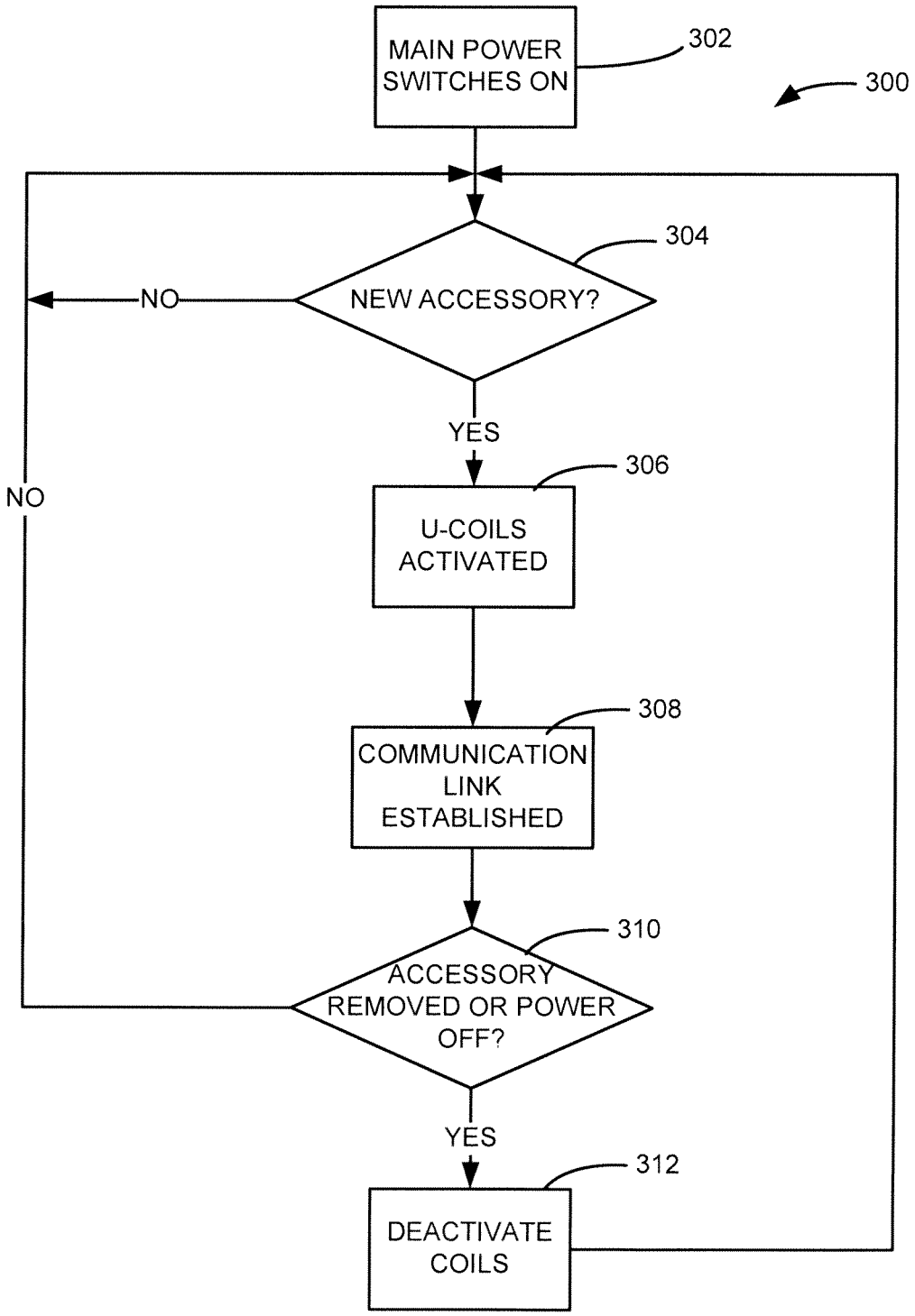
FIG. 8 is a flow chart of the steps of connecting an accessory to an inductively powering rail.
Figure 10:
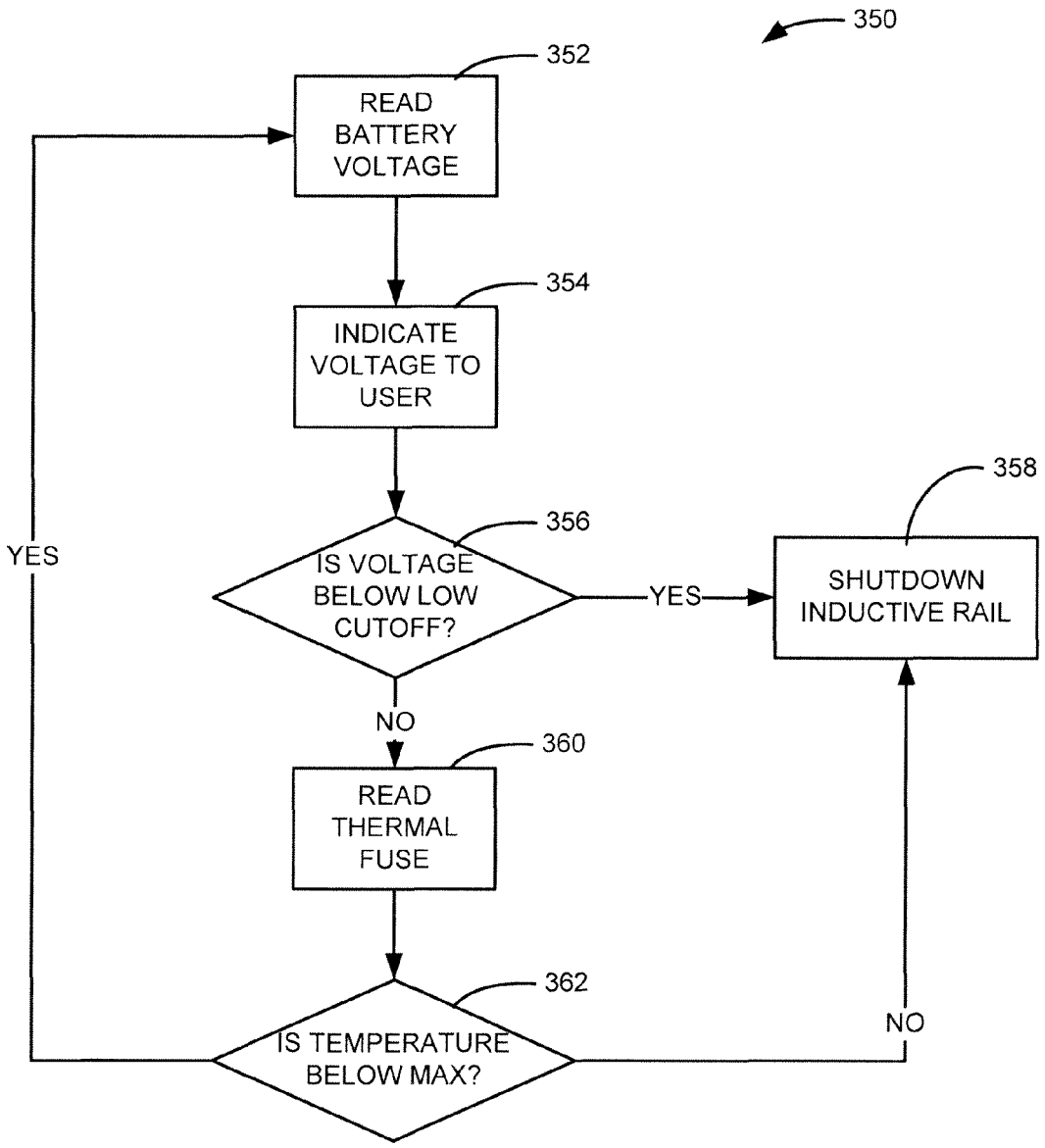
FIG. 10 is a flow chart of the steps for determining voltage and temperature of the system.

Before describing FIGS. 8, 9 and 10 in detail, we wish the reader to know that these Figures are flowcharts of processes that run in parallel, they each have their own independent tasks to perform. They may reside on any device but in one embodiment all would reside on master CPU 76.

Referring now to FIG. 8, a flow chart of the steps of connecting an accessory to an inductively powering rail is shown generally as 300. Beginning at step 302, the main system power switch is turned on by the user through the use of multi-button pad 88 or another switch as selected by the designer. Moving next to step 304 a test is made to determine if an accessory, such as feature 42 of FIG. 4 has been newly attached to inductively powering rail 14 and powered on or an existing accessory 42 connected to inductively powering rail 14 is powered on. At step 306 the magnets 46 on the accessory magnetize the pins 24 thereby closing the circuit on the primary PCB 54 via magnetic switch 48 and thus allowing the activation of the primary and secondary U-cores 26 and 50, should they be needed. This connection permits the transmission of power and communications between the accessory 42 and the inductively powering rail 14 (see features 90 and 92 of FIG. 4).

Moving now to step 308 a communication link is established between the master CPU 76 and the accessory via control inductive control path 92. Processing then moves to step 310 where a test is made to determine if an accessory has been removed or powered off If not, processing returns to step 304. If so, processing moves to step 312 where power to the primary and secondary U-Cores 26 and 50 for the accessory that has been removed.

FIG. 9 is a flow chart of the steps for managing power usage shown generally as 320. There may be a wide range of accessories 42 attached to an inductively powering rail 14. They range from low powered (1.5 to 2.0 watts) and high powered (greater than 2.0 watts). Process 320 begins at step 322 where a test is made to determine if system 70 requires power. This is a test conducted by master CPU 76 to assess if any part of the system is underpowered. This is a continually running process. If power is at an acceptable level, processing returns to step 322. If the system 70 does require power, processing moves to step 324. At step 324 a test is made to determine if there is an external power source. If so, processing moves to step 326 where an external power source such as 80 (see FIG. 4) is utilized. Processing then returns to step 322. If at step 324 it is found that there is no external power source, processing moves to step 328. At step 328 a test is made to determine if there is an auxiliary power source such as feature 102 (see FIG. 4). If so processing moves to step 330 where the auxiliary power source is utilized. Processing then returns to step 322. If at step 328 it is determined that there is no auxiliary power source, processing moves to step 332. At step 332 a test is made to determine if on board power is available. On board power comprises a power device directly connected to the inductively powering rail 14. If such a device is connected to the inductively powering rail 14, processing moves to step 334 where the system 70 is powered by on board power. Processing then returns to step 322. If at step 332 no on board power device is located processing moves to step 336. At step 336 a test is made to determine if there is available power in accessories. If so, processing moves to step 338 where power is transferred to the parts of the system requiring power from the accessories. Processing then returns to step 322. If the test at step 336 finds there is no power available, then the inductively powering rail 14 is shut down at step 340.

The above steps are selected in an order that the designers felt were reasonable and logical. That being said, they do not need to be performed in the order cited nor do they need to be sequential. They could be performed in parallel to quickly report back to the Master CPU 76 the options for power.

FIG. 10 is a flow chart of the steps for determining voltage and temperature of the system, shown generally as 350. Beginning at step 352 a reading is made of the power remaining in battery 78. The power level is then displayed to the user at step 354. This permits the user to determine if they wish to replace the batteries or recharge the batteries from external power source 80. Processing moves next to step 356 where a test is made on the voltage. In one embodiment the system 70 utilizes Lithium-Ion batteries, which provide near constant voltage until the end of their life, which allows the system to determine the decline of the batteries be they battery 78 or batteries within accessories. If the voltage is below a determined threshold processing moves to step 358 and system 70 is shut down. If at step 356 the voltage is sufficient, processing moves to step 360. At this step a temperature recorded by a thermal fuse is read. Processing then moves to step 362, where a test is conducted to determine if the temperature is below a specific temperature. Lithium-Ion batteries will typically not recharge below −5 degrees Celsius. If it is too cold, processing moves to step 358 where inductively powering rail 14 is shut down. If the temperature is within range, processing returns to step 352.

With regard to communication between devices in system 70 there are three forms of communication, control path 86, inductive control path 92 and Zigbee (198, 204). Control path 86 provides communications between master CPU 76 and inductively powered rails 14, 94 and 96. Inductive control path 92 provides communication between an accessory such as 42 with the inductively powered rails 14, 94 and 96. There are two lines of communication here, one between the rails and one between the accessories, namely control path 86 and inductive control path 92. Both are bidirectional. The Zigbee links (198, 204) provide for a third line of communication directly between an accessory such as 42 and master CPU 76.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method for providing inductive power to an accessory on a firearm; said method comprising:

detecting an accessory when attached to said firearm through actuation of a magnetic switch magnetically coupled to a magnet in the accessory via a pin located in the firearm and providing an inductive power path with said accessory; and providing power to said accessory from a secondary source should power be required.

2. The method of claim 1 further comprising: monitoring the power requirements of all accessories and reporting the same to the user, should power be too low determining if said accessories can be recharged based upon temperature and doing so if possible.

3. The method of claim 1 wherein said secondary source is an external power source.

4. The method of claim 1 wherein said secondary source is an auxiliary power source.

5. The method of claim 1 wherein said secondary source is an on board power device.

6. The method of claim 1 wherein said secondary source is power from an accessory.

7. A system for a powered rail of a firearm, comprising:

a powered rail operatively connected to a power supply;

an accessory configured to releasably engage the powered rail;

at least one pin located within the powered rail;

at least one magnet, located within the accessory;

at least one magnetic switch located within the powered rail, wherein the at least one pin is configured to magnetically couple the at least one magnet to the at least one magnetic switch when the accessory engages the powered rail.

8. The system as in claim 7, wherein the powered rail is configured to transfer power to and from the accessory when the accessory engages the powered rail.

9. The system as in claim 7, wherein the powered rail is configured to transfer data to and from the accessory when the accessory engages the powered rail.

10. A method for providing power to an accessory on a firearm; said method comprising:

detecting an accessory when attached to said firearm through actuation of a magnetic switch magnetically coupled to a magnet in the accessory via a pin located in the firearm and providing a power path with said accessory; and providing power to said accessory from a secondary source of power should power be required.

11. The method of claim 10 further comprising: monitoring the power requirements of all accessories and reporting the same to the user, should power be too low determining if said accessories can be recharged based upon temperature and doing so if possible.

12. The method of claim 10 wherein said secondary source is an external power source.

13. The method of claim 10 wherein said secondary source is an auxiliary power source.

14. The method of claim 10 wherein said secondary source is an on board power device.

15. The method of claim 10 wherein said secondary source is power from an accessory.

16. The method of claim 10, wherein the firearm further comprises: a powered rail operatively connected to the secondary source of power; wherein the accessory is configured to releasably engage the powered rail; and wherein the magnetic switch is located within the powered rail, wherein the pin is configured to magnetically couple the magnet to the magnetic switch when the accessory engages the powered rail.

17. The method of claim 10 further comprising a communication system for the powered rail, wherein the powered rail is configured to transfer power to and from the accessory when the accessory engages the powered rail.

18. The method as in claim 10, wherein the powered rail is configured to transfer data to and from the accessory when the accessory engages the powered rail.

* * * * *